US006420960B1

(12) United States Patent
Dorenbosch et al.

(10) Patent No.: US 6,420,960 B1
(45) Date of Patent: Jul. 16, 2002

(54) METHOD FOR OPTIMIZING MEMORY UTILIZATION OF A SELECTIVE CALL UNIT

(75) Inventors: Jheroen P. Dorenbosch, Paradise; Alain C. Briancon, McKinney, both of TX (US)

(73) Assignee: Motorola, Inc., Schaumburg, IL (US)

( * ) Notice: Subject to any disclaimer, the term of this patent is extended or adjusted under 35 U.S.C. 154(b) by 882 days.

(21) Appl. No.: 08/724,568

(22) Filed: Sep. 30, 1996

(51) Int. Cl.[7] ..... G08B 5/22
(52) U.S. Cl. ..... 340/7.52; 340/7.44
(58) Field of Search ..... 340/825.44, 825.46, 340/7.52, 7.44; 455/38.1, 38.3, 33.1

(56) References Cited

U.S. PATENT DOCUMENTS 4,868,560 A 9/1989 Oliwa
5,225,826 A * 7/1993 DeLuca ..... 340/825.44
5,412,719 A * 5/1995 Hamamoto ..... 340/825.44
5,473,320 A 12/1995 Deluca et al.
5,488,359 A * 1/1996 Faris ..... 340/825.44

* cited by examiner

*Primary Examiner*—Brian Zimmerman
(74) *Attorney, Agent, or Firm*—Charles W. Bethards

(57) ABSTRACT

A selective call unit (SCU) (122) is used for receiving a sequence of interspersed message fragments (FIG. 4) belonging to a plurality of messages transmitted by a messaging system. The SCU (122) receives a message length command from the messaging system indicating a total message length of a message pending transmission from the messaging system. Each message fragment includes a message portion of the plurality of messages and information indicating the length of the message fragment. The SCU (122) then determines whether there is sufficient memory available for receiving the message according to the message length command. The SCU (122) reserves memory space equivalent to the total message length when the total message length is equal to or less than available memory space, and disallows reception of the message when the total message length is greater than available memory space.

14 Claims, 4 Drawing Sheets

122

400

METHOD FOR OPTIMIZING MEMORY UTILIZATION OF A SELECTIVE CALL UNIT

FIELD OF THE INVENTION

This invention relates in general to selective call units receiving messages, and particularly to optimizing memory utilization of a selective call unit in one-way messaging system that transmits fragmented messages.

BACKGROUND OF THE INVENTION

Memory reservation is a standard procedure in two-way messaging systems. Before sending a message, the messaging system has the option of sending a query message to a selective call unit to establish that sufficient memory is available for storing a message. If the unit indicates that insufficient memory is available, the messaging system does not send the message. In some cases, the messaging system stores the message for future transmission on the theory that perhaps a few minutes later the selective call unit will have memory available to receive the message after, for example, the user of the unit having read messages and/or discarded messages from memory.

In contrast, sending a query to determine available memory capacity of a selective call unit is not possible in one-way messaging systems. Often one-way messaging systems using message fragmentation will transmit to a selective call unit a sequence of interspersed message fragments belonging to different messages, each message fragment including a portion of one of the messages transmitted, and information indicating the length of the message fragment. Because message fragments do not include information indicating the total length of the message being transmitted, a selective call unit receiving a sequence of interspersed message fragments will not know whether there is sufficient memory available to receive messages.

This leads to the situation where the selective call unit is unable to properly receive messages that could have otherwise been received individually, because memory is exhausted before all the message fragments for any one of the messages has been received. This may often result in the reception of one or more partially decoded messages, which generally is contrary to customer expectations.

Thus, what is needed is a method and apparatus that can improve utilization of memory in selective call units operating in one-way messaging systems that transmit fragmented messages.

DESCRIPTION OF THE PREFERRED EMBODIMENT

Figure 1:
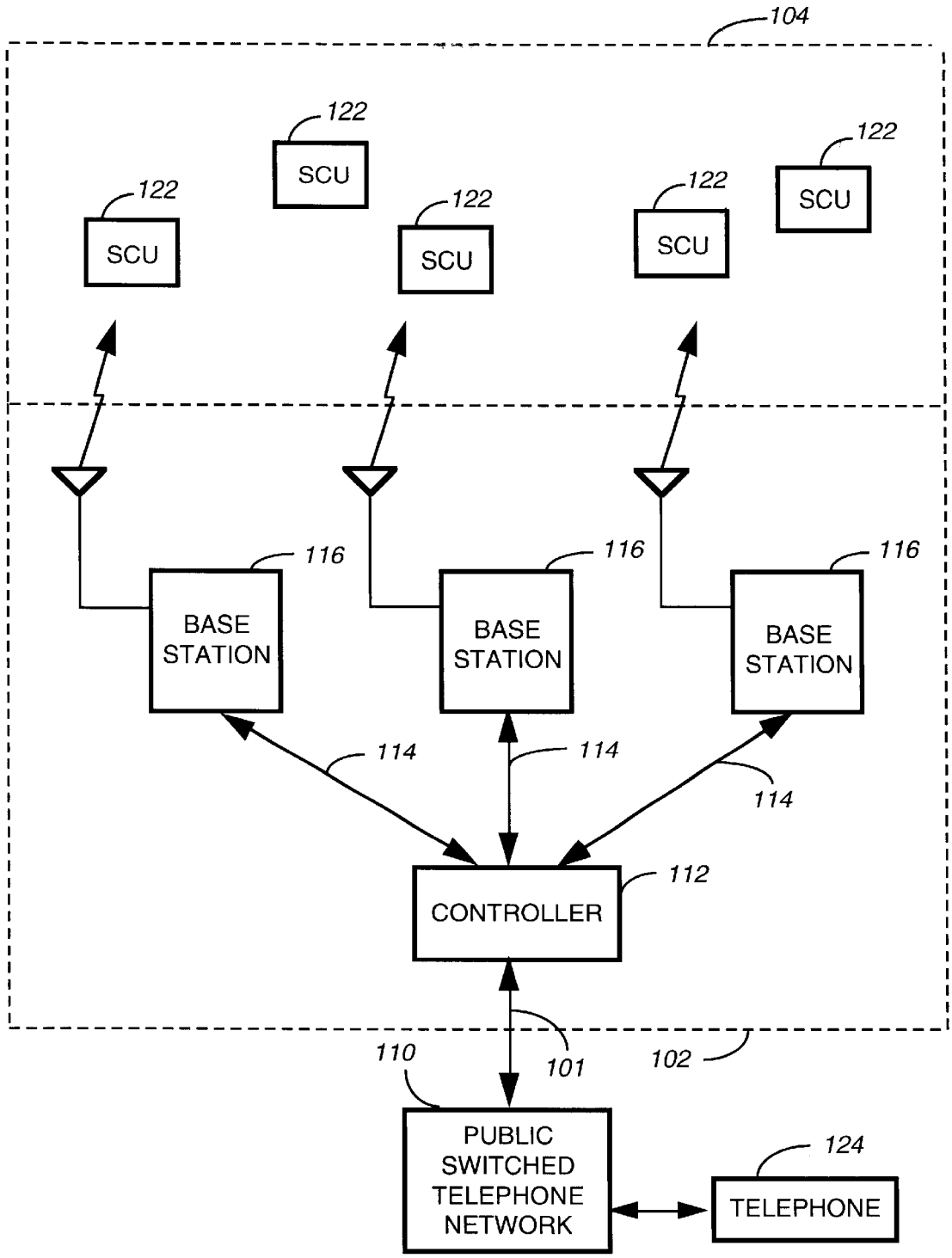
FIG. 1 is an electrical block diagram of a messaging system in which the present invention can be utilized.

FIG. 1 is an electrical block diagram of a one-way radio messaging system. The messaging system comprises a fixed portion 102 and a portable portion 104. The fixed portion 102 includes a controller 112 for controlling operation of a plurality of base stations 116 by way of conventional communication links 114, such as microwave links. The portable portion 104 includes a plurality of SCU's (selective call units) 122 for receiving messages from the base stations 116 under the control of the controller 112.

The controller 112 receives messages from callers utilizing a conventional; telephone 124 for communicating with a conventional PSTN (public switch telephone network) 110. The PSTN 110 relays messages to the controller 112 through a conventional telephone line 101 coupled to the controller 112. Upon receiving messages from the PSTN 110, the controller 112 processes the messages, and delivers them to the base stations 116 for transmission to designated SCU's 122.

Figure 2:
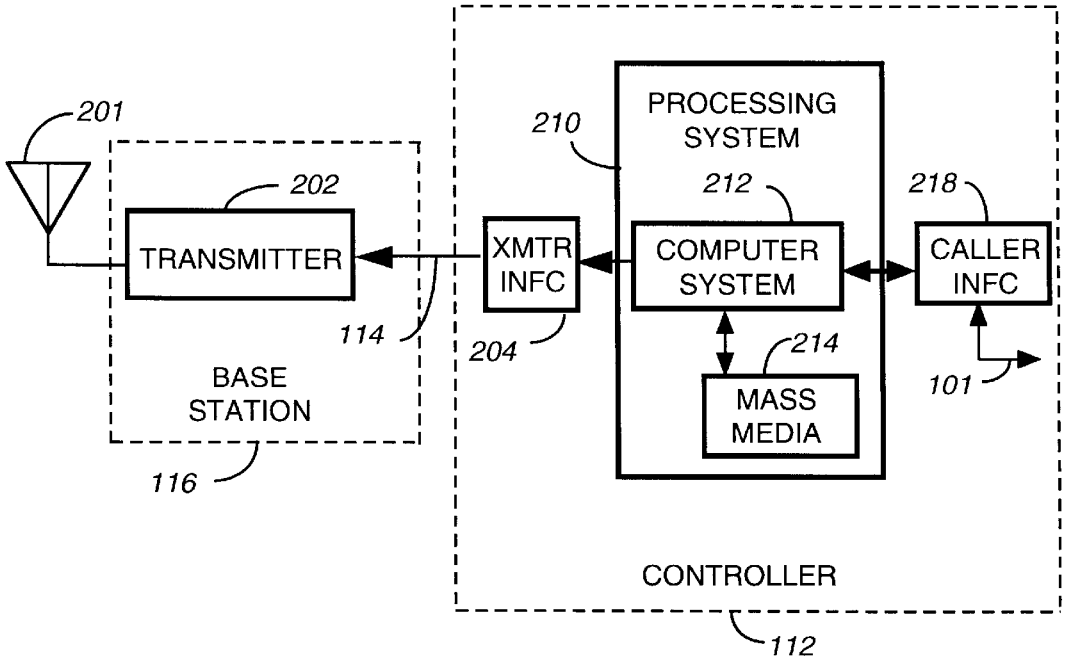
FIGS. 2 and 3 are electrical block diagrams of the fixed portion and the selective call unit of FIG. 1, respectively.
Figure 3:
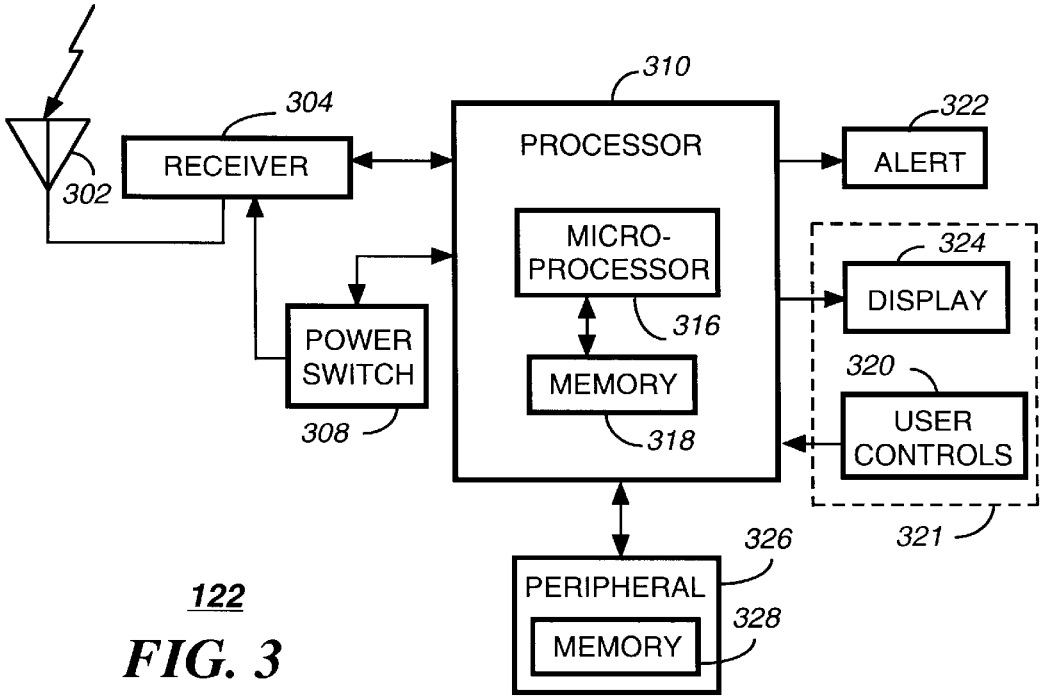

FIGS. 2 and 3 are electrical block diagrams of the fixed portion 102 and the SCU 122 of FIG. 1, respectively. The electrical block diagram of the fixed portion 102 includes the elements of the controller 112 and the base stations 116. The controller 112 comprises a conventional processing system 210 for controlling operation of the base stations 116, a conventional caller interface 218 for receiving messages from the PSTN 110, and a transmitter interface 204 for communicating messages to the base stations 116. The processing system 210 includes conventional hardware such as a computer system 212 and mass media 214 to perform the programmed operations of the controller 112. The base stations 116 comprise a conventional RF transmitter 202 coupled to an antenna 201 for transmitting the messages received from the controller 112.

The SCU 122 comprises a receiver 304 coupled to an antenna 302, a power switch 308, a processor 310, an alerting device 322, and a user interface 321. The receiver 304 and antenna 302 are conventional RF elements for receiving messages transmitted by the base stations 116. The power switch 308 is a conventional switch, such as a MOS (metal oxide semiconductor) switch for controlling power to the receiver 304 under the direction of the processor 310, thereby providing a battery saving function.

The processor 310 is used for controlling operation of the SCU 122. Generally, its primary function is to decode and process demodulated messages provided by the receiver 304, storing them and alerting a user of the received message. To perform this function, the processor 310 comprises a conventional microprocessor 316 coupled to a conventional memory 318 including nonvolatile and volatile memory portions, such as a ROM (read-only memory) and RAM (random-access memory). One of the uses of the memory 318 is for storing messages received from the base stations 116. Another use is for storing one or more selective call addresses utilized in identifying incoming messages belonging to the SCU 122.

Once a message has been decoded and stored in the memory 318, the processor 310 activates the alerting device 322 which generates a tactile and/or audible alert signal to the user. The user interface 321, which includes, for example, a conventional LCD display 324 and conventional user controls 320, is utilized by the user for processing the received messages. This interface provides options such as reading, deleting, and locking of messages, as well as, user selectable priority level settings for messages received.

The SCU 122 is also shown coupled to a peripheral device 326 including a memory 328. This peripheral device 326 can be, for example, a conventional computer that allows attachment of an SCU 122 thereto. This coupling allows the transfer of information (e.g., messages) between the SCU 122 and the peripheral device 326. This capability will become relevant in the discussions below.

Preferably, the one-way messaging system uses message fragmentation for transmitting messages to the SCU's 122. One example, of a protocol that transmits messages in fragments is the ReFlex protocol, developed by Motorola, Inc. (ReFlex is a trademark of Motorola, Inc.). The ReFlex protocol is a digital selective call signaling protocol that is presently used by various system operators in the United States and in several other countries. It will be appreciated that, alternatively, other digital signaling protocols that transmit messages in fragments can be used; however, for the discussion below it is assumed that ReFlex is the protocol used.

Generally, message fragmentation involves the process of dividing one or more messages into message fragments, each message fragment comprising a message portion and information indicating the length of the message fragment. Prior to transmitting message fragments, the controller 112 evaluates the existing traffic of the messaging system, and intersperses the transmission of message fragments in a manner that most efficiently utilizes system bandwidth. Improving the efficiency of the utilization of system bandwidth is one of the essential features of protocols that fragment messages.

Figure 4:
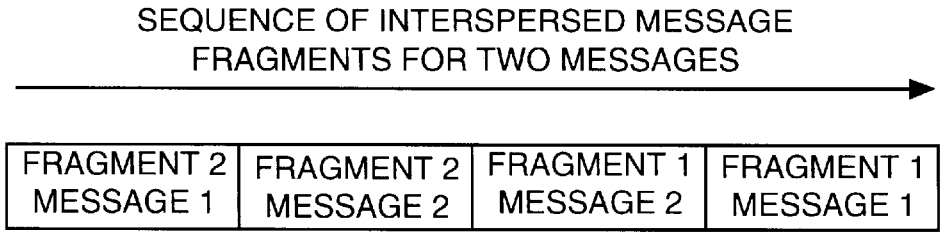
FIG. 4 is an illustration of a sequence of interspersed message fragments from two messages.

FIG. 4 is one example of how the controller 112 might designate the transmission of message fragments for two messages, messages 1 and 2. In this example, messages 1 and 2 each comprise two message fragments, fragments 1 and 2. Each fragment, as discussed above, includes a portion of the message being transmitting, and message length information that informs the SCU 122 of the expected length of the message portion being received. Note, the message fragments shown in this example are contiguous in time. However, this is not a necessary condition. In fact, in most instances message fragments are transmitted with gaps of time between each fragment. Any time lag of transmission between message fragments remains applicable to the present invention.

Since a protocol that transmits fragmented messages does not inform the SCU 122 of the full length of the message being transmitted, it is not possible for the SCU 122 to know, in this example, whether there will be sufficient memory to receive either or both messages 1 and 2. As shown in FIG. 4, the first fragments of messages 1 and 2 are transmitted in sequence. If these fragments combined are larger in capacity than the available memory capacity of the SCU 122, the result would be the partial reception of both messages 1 and 2. This result occurs even if messages 1 or 2 could have been received individually in total. Other combinations of interspersed fragments and fragment lengths could be shown to provide similar results. It is evident that receiving partial messages would be contrary to customer expectations. Thus, what is needed is a method for optimizing memory utilization of the SCU 122 in a manner that avoids partial message decoding.

Figure 5:
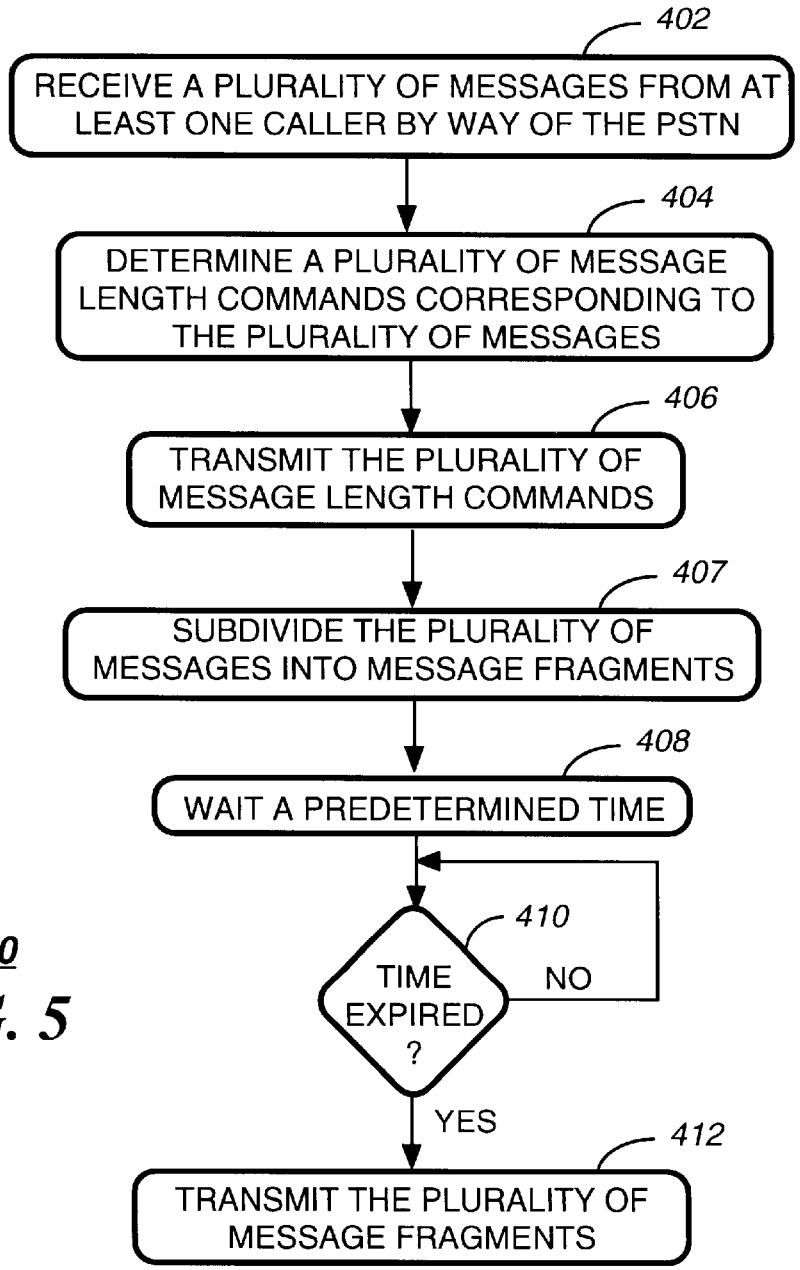
FIGS. 5 and 6 are flow charts depicting the operation of the controller and the selective call unit of FIG. 1, respectively, according to the present invention.
Figure 6:
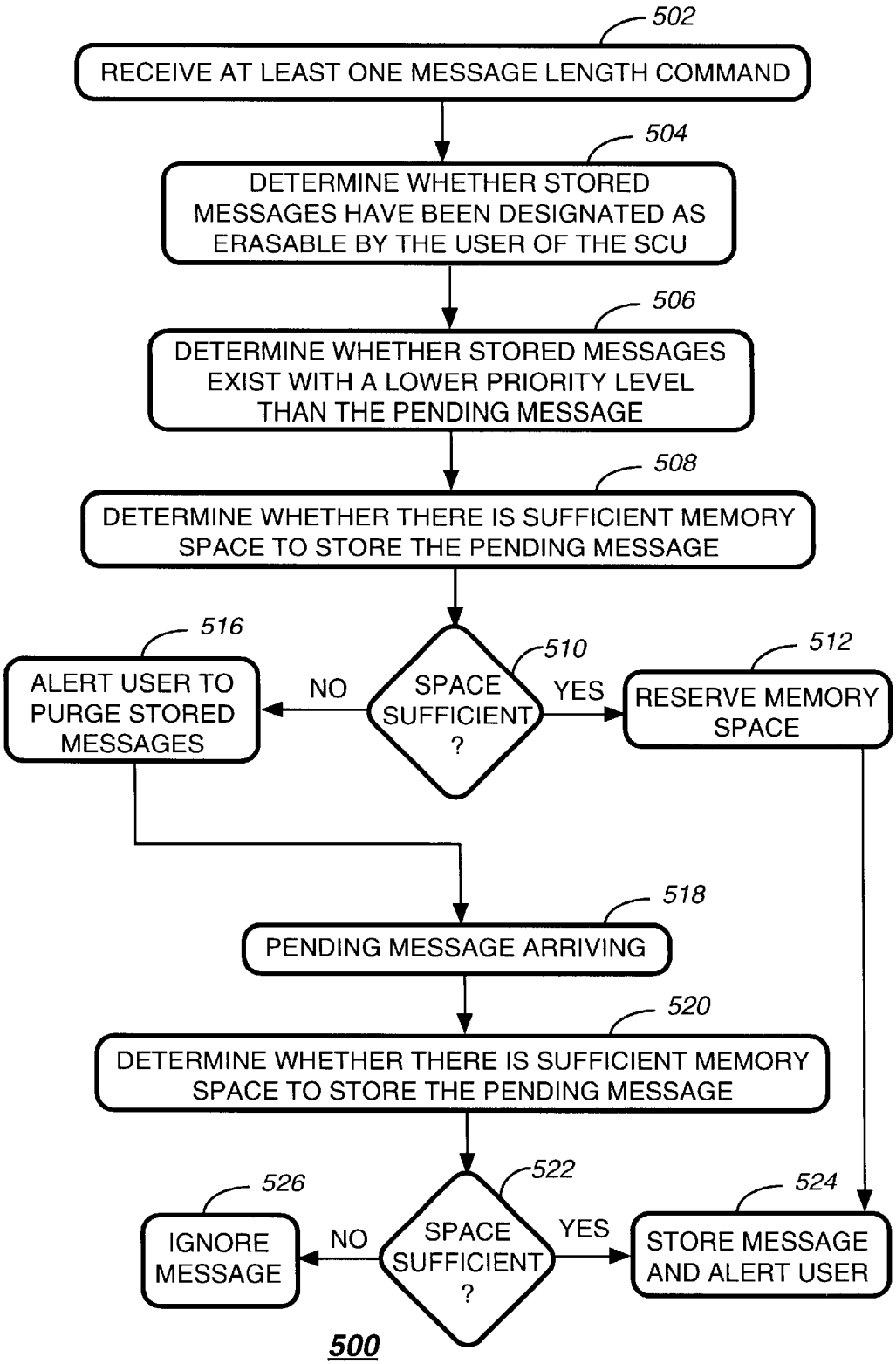

FIGS. 5 and 6 are flow charts 400, 500 depicting the operation of the controller 112 and the SCU 122 for solving this problem according to the present invention. Directing attention to FIG. 5, flow chart 400 depicts programmed instructions of the controller 112 which are stored in the mass media 214.

The flow chart 400 begins with step 402 where the controller 112 receives a plurality of messages from at least one caller using the PSTN 110. The messages are designated for transmission to one or more SCU's 122 in the messaging system as directed by the callers. In step 404, the controller 112 determines a plurality of message length commands each indicative of a message length of a corresponding one of the plurality of messages. In an alternative embodiment, the controller 112 is further programmed to determine a message priority level for each message to be included as part of the message length command. The example illustrated in FIG. 5 relates to the case where a plurality of message length commands are transmitted to an SCU 122 corresponding to a plurality of messages. It will be appreciated that a message length command is also transmitted for a single message pending transmission to an SCU 122.

The priority level can, for example, be set on the basis of the urgency of the message, or can be set by the controller 112, depending on a priority algorithm selected by the user of the designated SCU 122. One embodiment of the algorithm can be, for example, setting a high priority level for messages received from callers designated as important by the user, and a low priority level for other messages received from other callers.

Proceeding to step 406, the controller 112 directs the base stations 116 to transmit the plurality of message length commands to the corresponding SCU's 122. In an alternative embodiment, each message length command is transmitted in a corresponding one of a plurality of message fragments, each message fragment corresponding to a first message fragment of a corresponding one of the plurality of messages. The remaining portion of each of the plurality of messages is transmitted in the message fragments of step 412. This embodiment helps to reduce the overhead of sending the plurality of message length commands separate from the message fragments.

In step 407, the controller 112 subdivides the plurality of messages into message fragments and designates the order of their transmission to make the best use of available system bandwidth. Thereafter, the controller 112, in step 408, waits for a predetermined amount of time before transmitting the message fragments in step 412. The expiration of time is determined in step 410.

This delay, as will become apparent in flow chart 500 of the SCU 122, is used to provide the SCU 122 enough time to properly process the message length commands, and in some instances, to provide the user of the SCU 122 time to purge stored messages in order to make room for incoming messages. It will be appreciated that, alternatively, the controller 112 can skip steps 408 and 410 when it is determined that user interaction is not a programmable feature of the SCU 122, and the SCU 122 operates fast enough to perform memory management before messages are received by it.

Once the predetermined delay has expired, the controller 112 directs the base stations 116 to transmit to designated SCU's a predetermined number of interspersed message fragments, each message fragment corresponding to a portion of the plurality of messages. At this point, the controller 112 has completed its efforts to transmit the plurality of messages to the designated SCU's 122. The controller 112 then proceeds to step 402 for further processing of messages from callers.

Now directing attention to FIG. 6, flow chart 500 depicts programmed instructions of the SCU 122 which are stored in the memory 318. Flow chart 500 begins with step 502 where the SCU 122 receives at least one message length command from the base stations 116. Each message length command is indicative of a total message length and a priority level of a message pending transmission from the messaging system. The SCU 122 preferably processes the message length commands in the order they arrive. Each command is processed by the SCU 122 until the capacity of the memory 318 has been exhausted. Once this happens, if any unprocessed commands are present, the SCU 122 will designate messages corresponding to those commands as unstorable, and will therefore disallow decoding of them when they arrive.

In accordance with the alternative embodiment described above for programming step 406 of the controller 112, the SCU 122 receives the message command in a message fragment which corresponds to a first message portion of the message. This embodiment helps to reduce system overhead. However, in the situation where a large number of first message fragments are received, the SCU 122 may potentially run out of memory to store the first portions of messages transmitted by the messaging system, and an undesirable situation of partial message reception may occur. Hence, in messaging systems with heavy traffic it is preferable to receive the message length commands from the messaging system separate from message fragments of messages.

In step 504, the SCU 122 determines whether any stored messages have been designated as erasable by the user of the SCU 122. The SCU 122 further determines, in step 506, whether there are any stored messages with a lower priority level than the message pending transmission from the messaging system, the priority level preferably being derived from the messaging system which originally transmitted a priority level with the message which is now stored.

Alternatively, the priority level of each stored message can be set by the user of the SCU 122 by way of the user interface 321 based on the type of messages stored, e.g., setting a high priority level for business news messages, and a lower priority level for sports news messages. Such a setting can be programmed by the user once; thereafter, priority levels would be set automatically. Yet another approach would be for the user to set a priority level for designated stored messages such that pending messages always have higher priority. Hence in this embodiment, the designated stored messages would always be deleted, because they have a lower priority level than the pending message(s).

At the completion of steps 504 and 506, the SCU 122 automatically designates stored messages erasable based on the messages selected in those steps. In step 508, the SCU 122 makes its first determination of whether there is sufficient memory available to receive the pending message according to the results of steps 504 and 506. This determination is made from calculating available memory space from the amount of memory freed by stored messages designated as erasable and unused memory space.

If the total message length of the pending message is equal to or less than the available memory space, then the SCU 122 proceeds to step 512 and reserves memory space equivalent to the total message length. Completion of this step represents the deletion of the designated messages. Hence, at this point the user of the SCU 122 will not be capable of retrieving the erased messages for future use. When the message is finally received, it is stored in the memory 318 and the user is alerted, in step 524. The SCU 122 will at some point between steps 512 and 524 proceed to step 502 if there are further unprocessed message length commands while it is waiting to receive the pending message(s) from the messaging system. This form of parallel functionality is performed by conventional programming techniques applied to the processor 310 performing the programming steps of flow chart 500.

If in step 510 it is determined that there is insufficient memory space, the SCU 122 proceeds to step 516 where it alerts the user of the SCU 122, by way of the alerting device 322, seeking the user's assistance to purge stored messages in order to further free up memory space. The user is given a predetermined time to purge stored messages. This step provides the reason for the controller 112 delaying transmission of the message fragments in steps 408 and 410. It will be appreciated that, alternatively, the SCU 122 can skip step 516, and instead be programmed to ignore the reception of messages when steps 504 and 506 fail to provide adequate memory space for storage. In this embodiment, programming steps 408 and 410 of the controller 112 would not be necessary.

In an alternative embodiment, step 516 can be eliminated or accompanied by the step of (not shown in the flow chart 500) transferring messages to the peripheral device 326 if it is coupled to the SCU 122 at the time the SCU 122 is searching for means to free up memory space. If the peripheral device 326 has sufficient memory to store messages from the SCU 122, then the SCU 122 will make a transfer of stored messages, and proceed to step 524 for storing the pending message when it arrives. Utilizing the memory 328 of the peripheral device 326 provides the additional feature of protecting the user from the step of deleting stored messages that the user may at a later time find useful.

Assuming this is not the case, the SCU 122 proceeds to step 518 when it detects the arrival of the pending message. In step 520, the SCU 122 determines whether there, is sufficient memory space to store the message based on the user's interaction in step 516. If not, the SCU 122 proceeds to step 526 where it ignores the message. Otherwise, the SCU 122 proceeds from step 522 to step 524 where it stores the message and alerts the user. As before, the SCU 122 will at some point between steps 516 and 518 proceed to step 502 if there are further unprocessed message length commands.

As the above discussions illustrate, the present invention provides a method for SCU's 122 to avoid partial message decoding. This is accomplished by transmitting a message length command to the SCU 122 prior to sending a corresponding set of message fragments representative of a message generated by a caller. Although at first glance it may seem that sending message length commands could have an adverse effect on bandwidth utilization, an evaluation of the performance of the SCU's in the aggregate provides a different conclusion. This is primarily due to the reduced need for callers and users (receiving partial decoded messages) having to request retransmission of messages that were not properly received by the SCU's 122.

By informing the SCU's 122 of the length of a message before it is received, the SCU's 122 can make every attempt possible to provide storage room for the message prior to its reception. Such attempts include, as described above, detection of messages designated as erasable by the user of the SCU 122, automatically designating as erasable stored messages with a lower priority level than the message pending transmission, and, in the worst case situation, alerting the user to purge stored messages. Only after all these attempts have been exhausted will the SCU 122 ignore reception of a message it cannot store. More often than not, however, the SCU 122 will have memory space available for storing an incoming message after implementing the method of the present invention.

What is claimed is:

1. In a selective call unit that receives a sequence of interspersed message fragments transmitted by a messaging system, a method for optimizing memory utilization of the selective call unit, the method comprising in the selective call unit the steps of:

receiving a message length command from the messaging system indicating a total message length of a message, said message including a plurality of interspersed message fragments, pending transmission from the messaging system;

determining whether there is sufficient memory available in the selective call unit according to the message length command;

reserving memory space equivalent to the total message length for receiving the message when the total message length is equal to or less than available memory space; and disallowing reception of the message when the total message length is greater than available memory space.

2. The method as set forth in claim 1, wherein the message length command is included in a first message fragment corresponding to a first message portion of the message.

3. The method as set forth in claim 1, further comprising the step of receiving from a user of the selective call unit a selection of stored messages designated to be erasable.

4. The method as set forth in claim 3, wherein the step of determining available memory space is calculated from an amount of memory freed by stored messages designated as erasable and unused memory space.

5. The method as set forth in claim 1, the message length command further indicating a priority level of the message pending transmission.

6. The method as set forth in claim 5, wherein each message stored in the selective call unit includes a message priority level originally transmitted by the messaging system;

the selective call unit further including the steps of:

automatically selecting stored messages with a lower priority level than the message pending transmission, and designating selected messages to be erasable; and determining available memory space from an amount of memory freed by stored messages designated as erasable and unused memory space.

7. The method as set forth in claim 5, further comprising the steps of:

receiving from a user of the selective call unit a priority level for each message stored in the selective call unit;

automatically selecting stored messages with a lower priority level than the message pending, and designating selected messages to be erasable; and determining available memory space from an amount of memory freed by stored messages designated as erasable and unused memory space.

8. The method as set forth in claim 1, further comprising the step of alerting a user of the selective call unit to purge stored messages within a predetermined time to make room for the message pending transmission.

9. The method as set forth in claim 1, the selective call unit further including the step of transferring stored messages in the selective call unit to a peripheral device having memory coupled to the selective call unit to make room for the message when available memory space is insufficient to store the message.

10. In a selective call unit that receives a sequence of interspersed message fragments transmitted by a messaging system, a method for optimizing memory utilization of the selective call unit, the method comprising in the selective call unit the steps of:

receiving a message length command from the messaging system indicative of a total message length and a priority level of a message, said message including a plurality of interspersed message fragments, pending transmission from the messaging system;

determining whether there is sufficient memory available in the selective call unit according to the total message length and according to stored messages each having a message priority level, the determining step including the steps of:

automatically selecting stored messages with a lower priority level than the message, and designating selected messages to be erasable, and determining available memory space from an amount of memory freed by stored messages designated as erasable and unused memory space;

reserving memory space equivalent to the total message length for receiving the message when the total message length is equal to or less than available memory space;

alerting a user of the selective call unit to purge stored messages within a predetermined time to make room for the message when the total message length is greater than available memory space; and disallowing reception of the message when, after completing the steps of automatically designating stored messages erasable and the user purging stored messages, the total message length is greater than available memory space.

11. A messaging system for transmitting to a selective call unit a sequence of interspersed message fragments, the messaging system comprising:

a caller interface for receiving a plurality of messages from a caller communicating with the messaging system, the plurality of messages are designated for transmission to the selective call unit as directed by the caller;

a transmitter for transmitting information to the selective call unit;

a controller couple to the caller interface and coupled to the transmitter for controlling operations of the messaging system, wherein the controller is programmed to:

determine a plurality of message length commands each indicative of a message length of a corresponding one of the plurality of messages; and cause the transmitter to transmit, to the selective call unit, the plurality of message length commands, and a predetermined number of interspersed message fragments corresponding to a portion of the plurality of messages;

the selective call unit further comprising:

a receiver for receiving a message length command, from the plurality of message length commands, indicative of the message length of a corresponding one of the plurality of messages;

a memory for storing messages received from the messaging system; and a processor coupled to the memory and coupled to the receiver for controlling operations of the selective call unit, and for determining whether there is sufficient memory available for receiving the corresponding one of the plurality of message according to the message length command, wherein the processor is programmed to:

reserve memory space in the memory equivalent to the total message length for receiving the corresponding one of the plurality of message when the total message length is equal to or less than available memory space, and disallow reception of the message when the total message length is greater than available memory space.

12. A messaging system for transmitting to at least one selective call unit sequence of interspersed message fragments, the messaging system comprising:

a caller interface for receiving a plurality of messages from at least one caller communicating with the messaging system, the plurality of messages are designated for transmission to the at least one selective call unit as directed by the at least one caller;

a transmitter for transmitting information to the at least one selective call unit;

a controller couple to the caller interface and coupled to the transmitter for controlling operations of the messaging system, wherein the controller is programmed to:

determine a plurality of message length commands each indicative of a message length of a corresponding one of the plurality of messages; and cause the transmitter to transmit, to the at least one selective call unit, the plurality of message length commands, and a predetermined number of interspersed message fragments corresponding to a portion of the plurality of messages, wherein each message length command is transmitted in a corresponding one of a plurality of message fragments, each message fragment corresponding to a first message fragment of a corresponding one of the plurality of messages, and wherein the predetermined number of interspersed message fragments comprise a subsequent set of message fragments to complete transmission of the plurality of messages.

13. In a messaging system having a transmitter for transmitting to a selective call unit a sequence of interspersed message fragments, a method for optimizing memory utilization of the selective call unit, the method comprising in the messaging system the steps of:

receiving a plurality of messages from a least one caller communicating with the messaging system, the plurality of messages pending transmission to the selective call unit;

determining a plurality of message length commands each indicative of a message length of a corresponding one of the plurality of messages; and causing the transmitter to transmit, to the selective call unit, the plurality of message length commands, and a predetermined number of interspersed message fragments corresponding to a portion of the plurality of messages, wherein each message length command is transmitted in a corresponding one of plurality of message fragments, each message fragment corresponding to a first message fragment of a corresponding one of the plurality of messages, and wherein the predetermined number of interspersed message fragments comprise a subsequent set of message fragments to complete transmission of the plurality of messages.

14. A selective call unit that receives a sequence of interspersed message fragments transmitted by a messaging system, the selective call unit comprising:

a receiver for receiving a message length command from the messaging system indicating a total message length of a message, said message including a plurality of interspersed message fragments, pending transmission from the messaging system;

a memory for storing messages received from the messaging system; and a processor coupled to the memory and coupled to the receiver for controlling operations of the selective call unit, and for determining whether there is sufficient memory available for receiving the message according to the message length command, wherein the processor is programmed to:

reserve memory space in the memory equivalent to the total message length for receiving the message when the total message length is equal to or less than available memory space, and disallow reception of the message when the total message length is greater than available memory space.

* * * * *